US009212807B2

(12) United States Patent
Ni

(10) Patent No.: US 9,212,807 B2
(45) Date of Patent: Dec. 15, 2015

(54) METHOD OF ASSEMBLING A MODULAR LED RECESSED FIXTURE

(71) Applicant: Yaxi Ni, Rancho Cucamonga, CA (US)

(72) Inventor: Yaxi Ni, Rancho Cucamonga, CA (US)

( * ) Notice: Subject to any disclaimer, the term of this patent is extended or adjusted under 35 U.S.C. 154(b) by 260 days.

(21) Appl. No.: 14/074,723

(22) Filed: Nov. 8, 2013

(65) Prior Publication Data

US 2014/0331489 A1 Nov. 13, 2014

Related U.S. Application Data

(60) Provisional application No. 61/821,727, filed on May 10, 2013.

(51) Int. Cl.

| | |
|---|---|
| ***F21K 99/00*** | (2010.01) |
| ***F21V 23/00*** | (2015.01) |
| ***F21V 19/04*** | (2006.01) |
| *F21V 15/015* | (2006.01) |
| *F21Y 101/02* | (2006.01) |
| *F21Y 105/00* | (2006.01) |
| *F21Y 113/00* | (2006.01) |

(52) U.S. Cl.

CPC ..... *F21V 23/003* (2013.01); *F21V 19/045* (2013.01); *F21V 15/015* (2013.01); *F21Y 2101/02* (2013.01); *F21Y 2105/001* (2013.01); *F21Y 2113/00* (2013.01); *Y10T 29/49117* (2015.01)

(58) Field of Classification Search

CPC ... F21V 15/015; F21V 19/045; F21V 23/003; F21Y 2101/02; F21Y 2105/001; F21Y 2113/00; Y10T 29/49117

See application file for complete search history.

(56) References Cited

FOREIGN PATENT DOCUMENTS

JP 4995997 B2 * 8/2012

* cited by examiner

*Primary Examiner* — Carl Arbes

(74) *Attorney, Agent, or Firm* — Law Offices of Steven W. Weinrieb

(57) ABSTRACT

A method of assembling a modular LED recessed fixture has the steps of: building LED module, building LED driver device, assembling LED modules to main frame, and assembling LED driver device to main frame. Since LED module elements and LED driver device of the said fixture are replaceable, the fixture could be easily maintained or upgraded by changing the corresponding elements.

4 Claims, 13 Drawing Sheets

METHOD OF ASSEMBLING A MODULAR LED RECESSED FIXTURE

CROSS-REFERENCE TO RELATED APPLICATIONS

Provisional application No. 61821727, filed on May 10, 2013

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

FIELD OF THE INVENTION

The present invention relates to a method of assembling a modular LED recessed fixture. In particular, the LED recessed fixture has at least one LED module, LED driver device, and main frame.

BACKGROUND OF THE INVENTION

With reference to FIGS. 12*a* and 12*b*, a conventional LED fixture 10 has a front frame 100, a diffuser sheet 101, a locking device 102, an LED array 103, a baffle fixture 104, a junction box 105*a* and its top plate 105*b*, an LED driver 106. Front frame 100, typically made of metal material, is combined with diffuser sheet 101. Locking device 102 is arranged on top of diffuser sheet 101, and securely coupled with front frame 100. LED array 103, consisting of printed circuit board 107 and a plurality of light-emitting diodes 108, is arranged inside of baffle fixture 104. Junction box 105*a* is arranged on backside of baffle fixture 104. LED driver 106 is arranged inside of junction box 105*a* and top plate 105*b* is coupled on top of junction box 105*a*. LED array 103 is electrically connected with and configured to source power from LED driver 106. Locking device 102 is securely coupled with baffle fixture 104, thus the conventional LED fixture 10 is enclosed. However the conventional LED fixture 10 has following disadvantages.

1. LED Array 102 is High Cost

For the purpose of outputting smooth light, numerous light-emitting diodes should be arranged on printed circuit board of LED fixture 10. In one embodiment, at least 196 pieces of light-emitting diodes are arranged on printed circuit board of 2 feet by 2 feet fixture; in a second embodiment, at least 392 pieces of light-emitting diodes are arranged on printed circuit board of 2 feet by 4 feet fixture. Consequently, the cost of LED array 102 is high.

2. LED array 102 is Non-replaceable

LED array 102 is securely coupled on back plate 103 inside of LED fixture 10 which is sealed. In the event of failure of any one or more light-emitting diodes, the whole LED fixture 10 shall be replaced, since the LED array 102 cannot be accessed or serviced at user's site.

SUMMARY OF THE INVENTION

The main objective of the invention is to provide a quick and easy method of assembling a modular LED recessed fixture.

A method of assembling a modular LED recessed fixture has the steps of: building LED module, building main frame, building LED driver device, assembling LED modules to main frame, and assembling LED driver device to main frame. The simplified process provides an easy and efficient way to manufacture and maintain a lighting fixture.

Other objectives, advantages and novel features of the invention will become more apparent from the following detailed description when taken in conjunction with the accompanying drawings.

BRIEF DESCRIPTION OF THE DRAWINGS

The present invention will be further understood from the following description with reference to the accompanying drawings, in which.

DETAILED DESCRIPTION OF THE INVENTION

Figure 1:
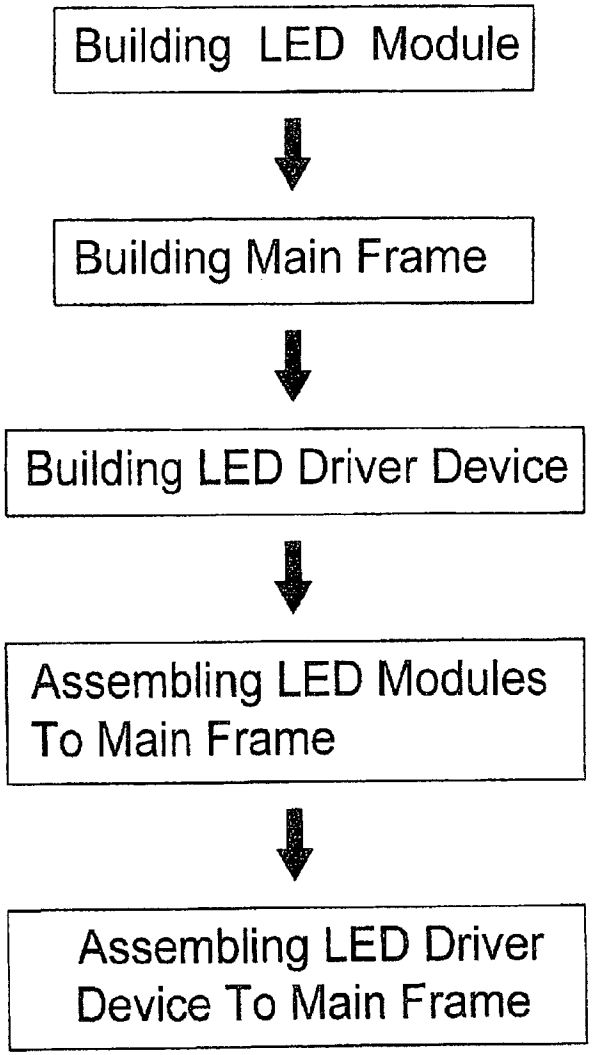
FIG. 1 is a block diagram of steps of a method of assembling a modular LED recessed fixture.
Figure 2:
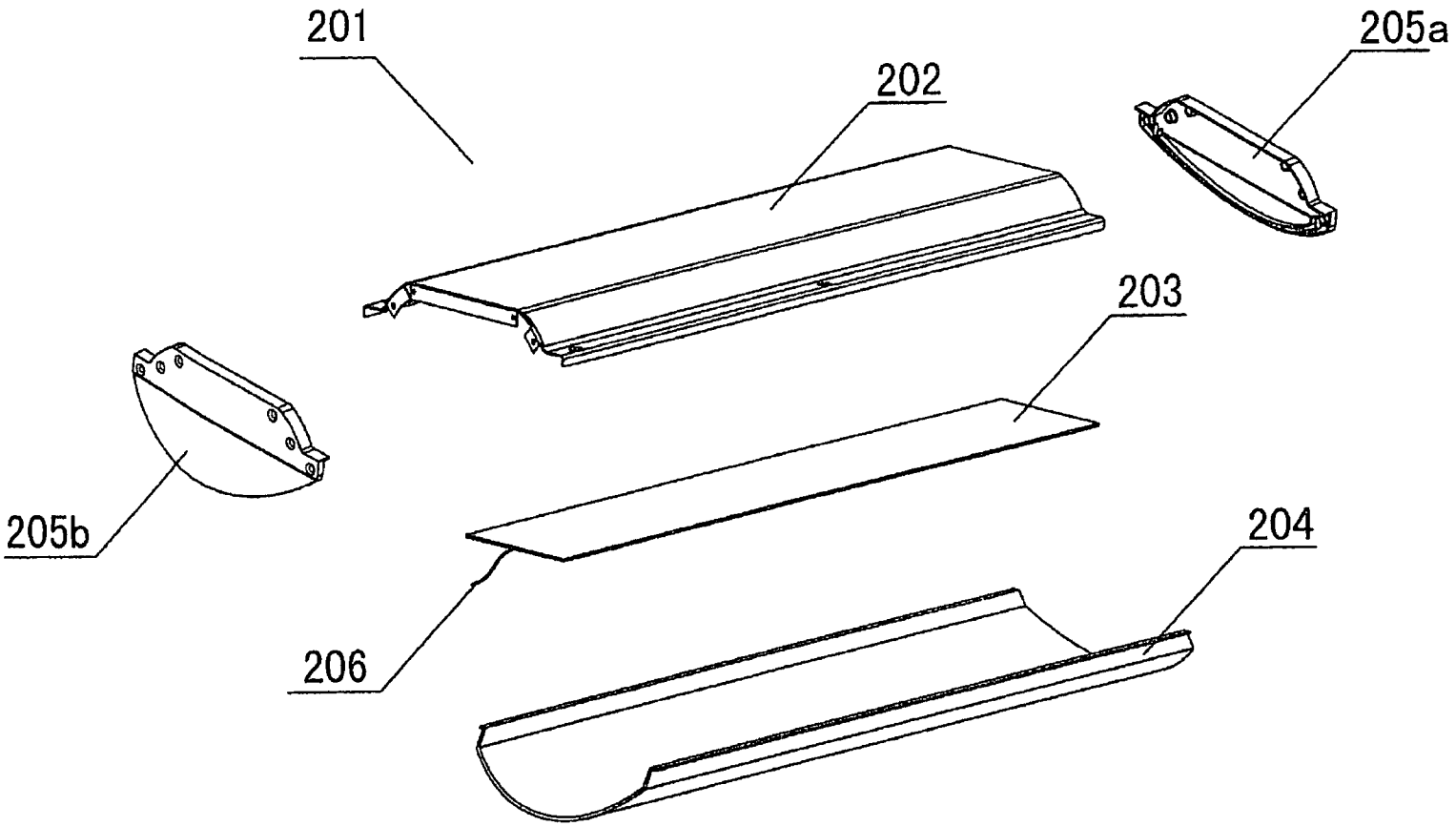
FIG. 2 is the exploded view of an LED module built in FIG. 1.
Figure 3:
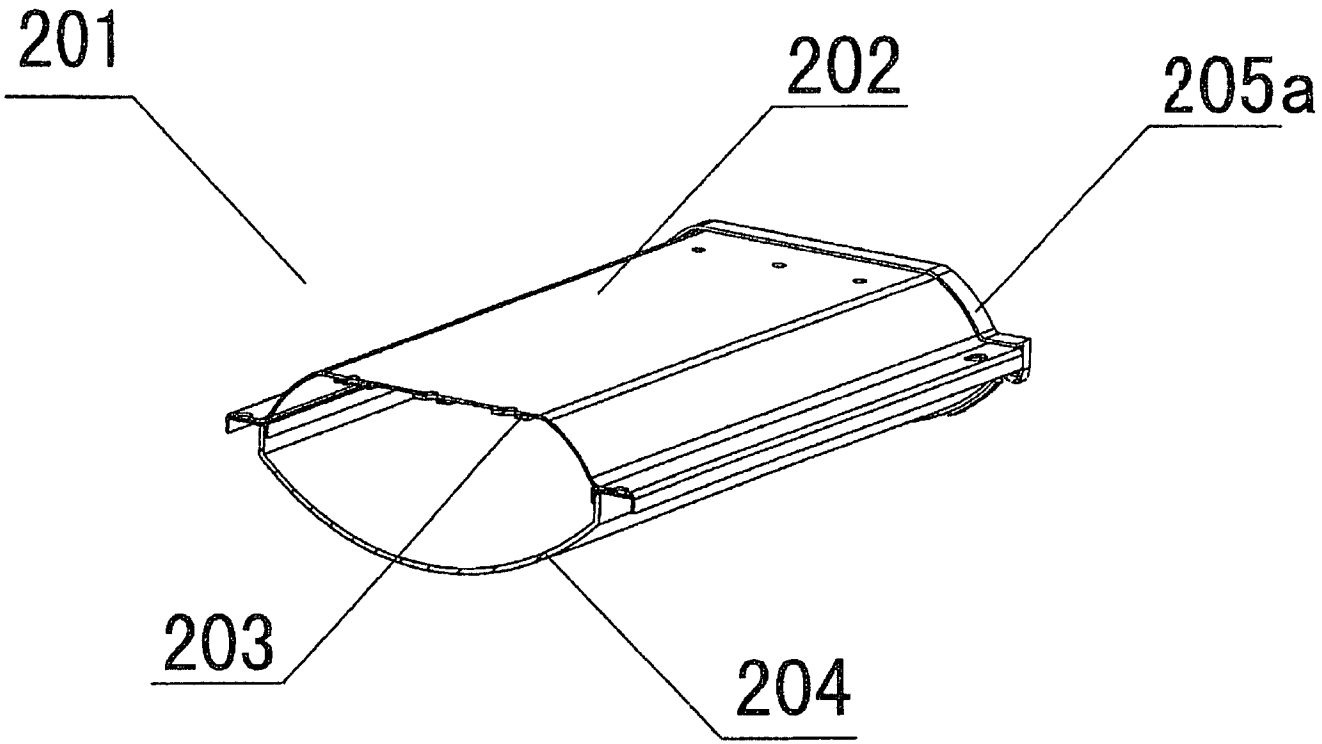
FIG. 3 is the section view of an LED module built in FIG. 1.

With reference to FIGS. 1 to 11, a method of assembling a modular LED recessed fixture 20 comprises the following steps:

Building LED Module 201

LED module 201 has a base 202, at least one LED array 203, a diffuser 204, a first end cap 205*a*, a second end cap 205*b* and electrical wire 206. The base 202, typically made of metal, is rigid and linear and has a first end and a second end. The base 202 forms a channel and extends from end to end of the modular LED recessed fixture 20. The LED array 203 characterized in comprising a plurality of light-emitting diodes and a printed circuit board (PCB). The PCB is rigid and of metal core (for example aluminum) based type. At least one LED array 203 is arranged on the bottom of base 202. Diffuser 204 is an arched plastic and frosted element. Diffuser 204 is securely coupled on top of base 202. End caps 205*a* and 205*b* are plastic and securely coupled on each side of base 202. Electrical wire 206 is coupled on LED array 203 and leads out through any of the end caps 205*a* and 205*b*.

Building Main Frame 207

Figure 4:
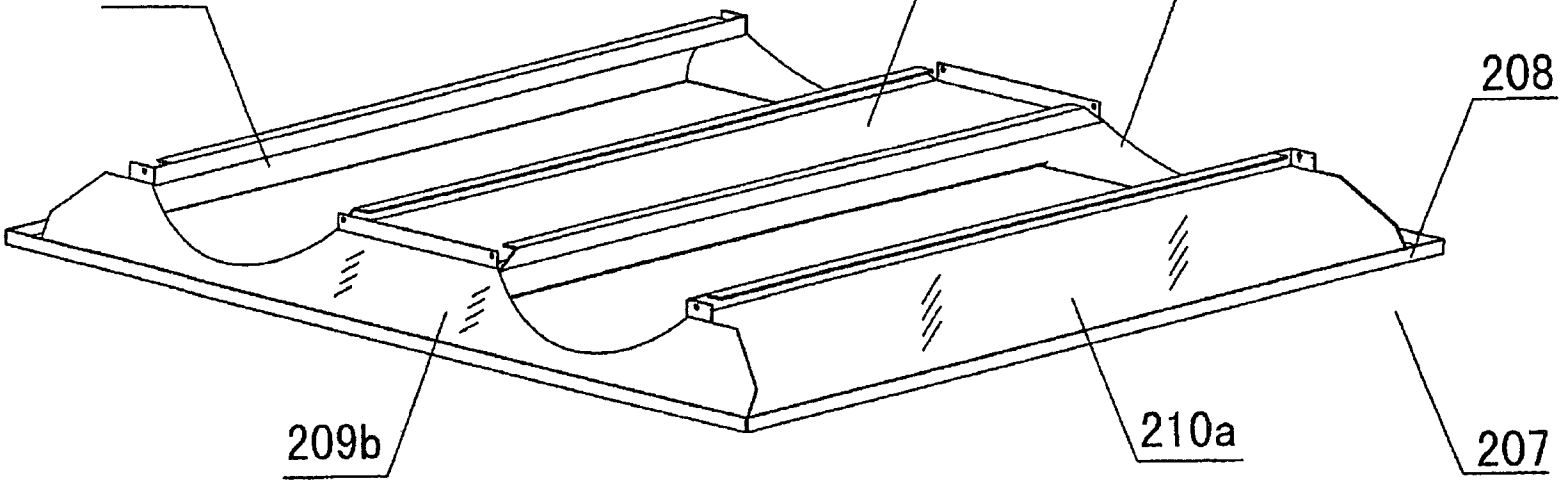
FIG. 4 is illustrates the main frame built in FIG. 1.
Figure 5:
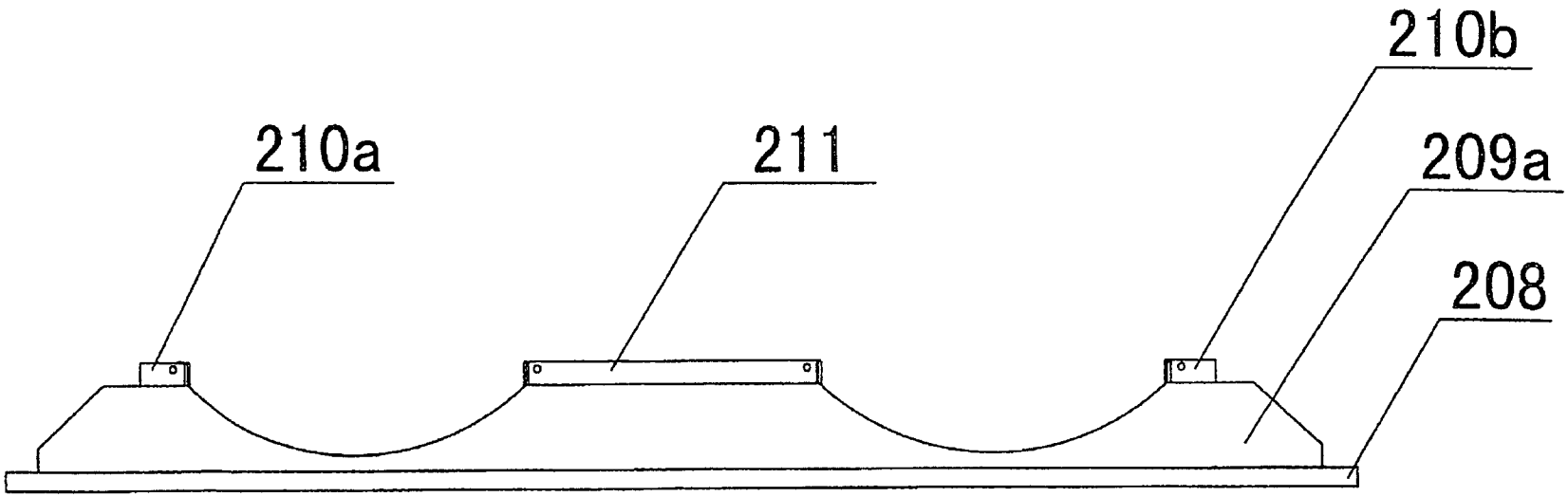
FIG. 5 is the side view of the main frame built in FIG. 1.
Figure 6:
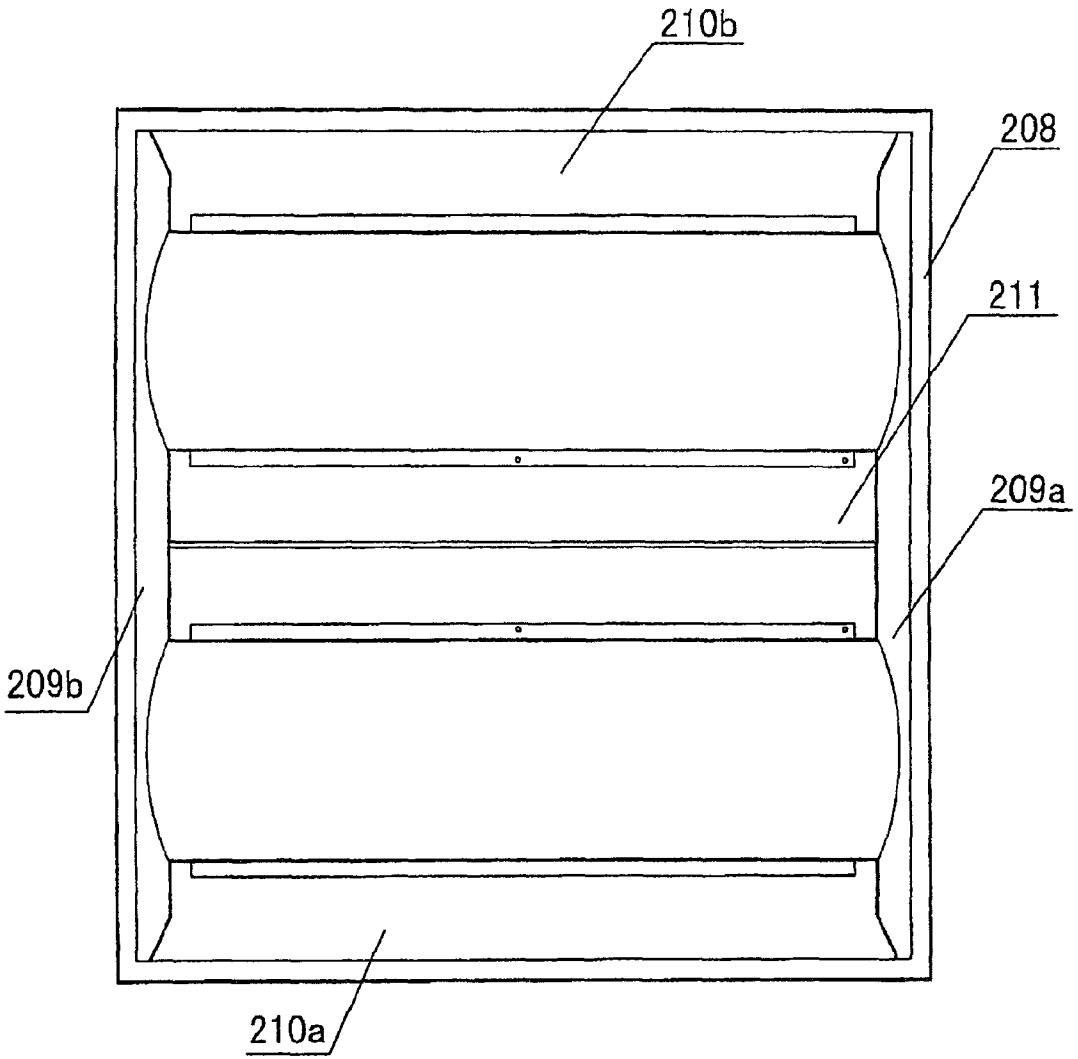
FIG. 6 is the rear view of the main frame built in FIG. 1.
Figure 7:
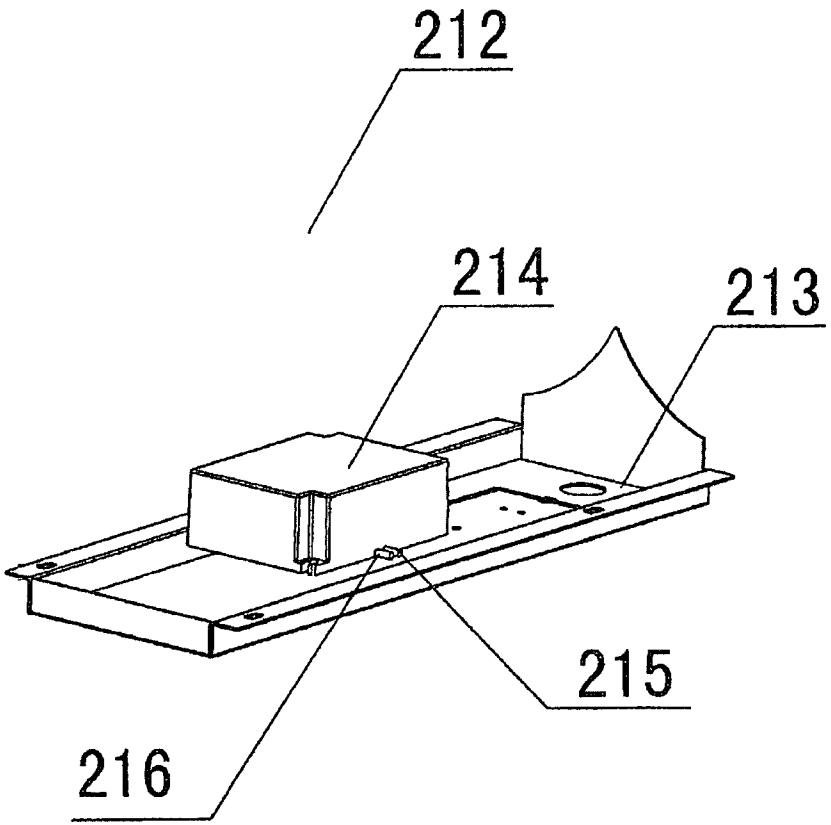
FIG. 7 illustrates an LED driver device comprising a plate, an LED driver, input wire and output wire.
Figure 8:
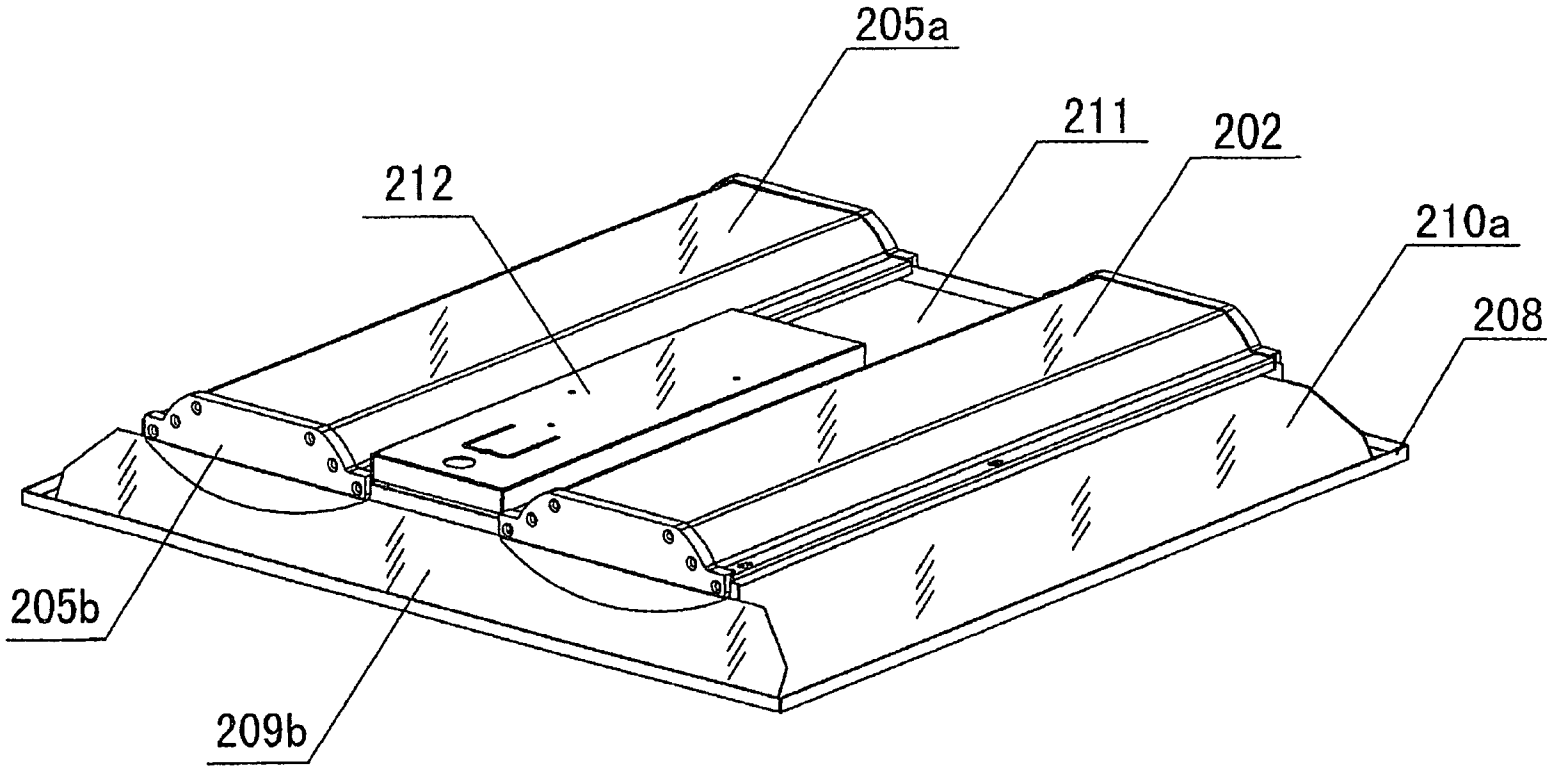
FIG. 8 illustrates the LED recessed fixture built in FIG. 1.
Figure 9:
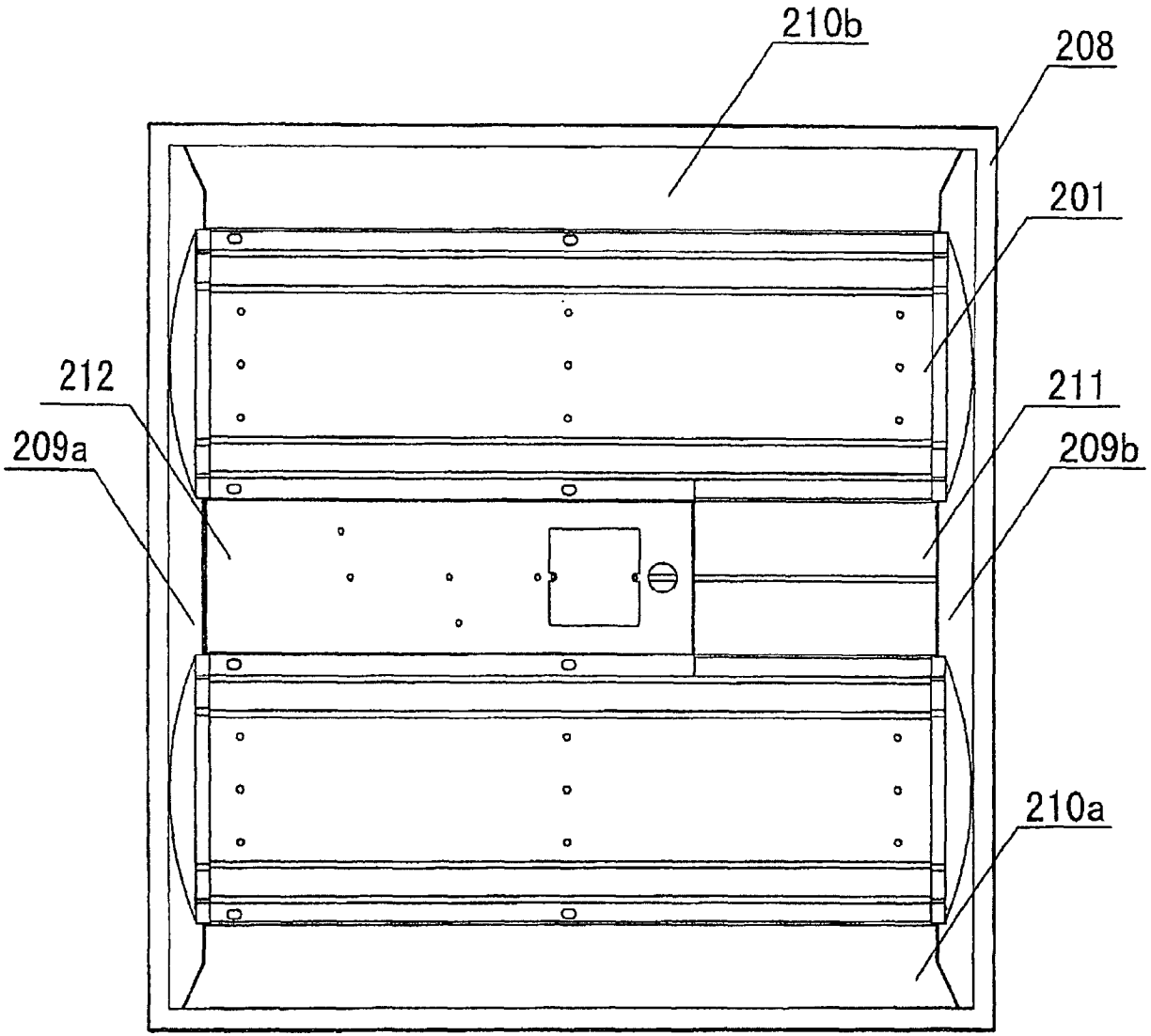
FIG. 9 is the rear view of the LED recessed fixture built in FIG. 1.
Figure 10:
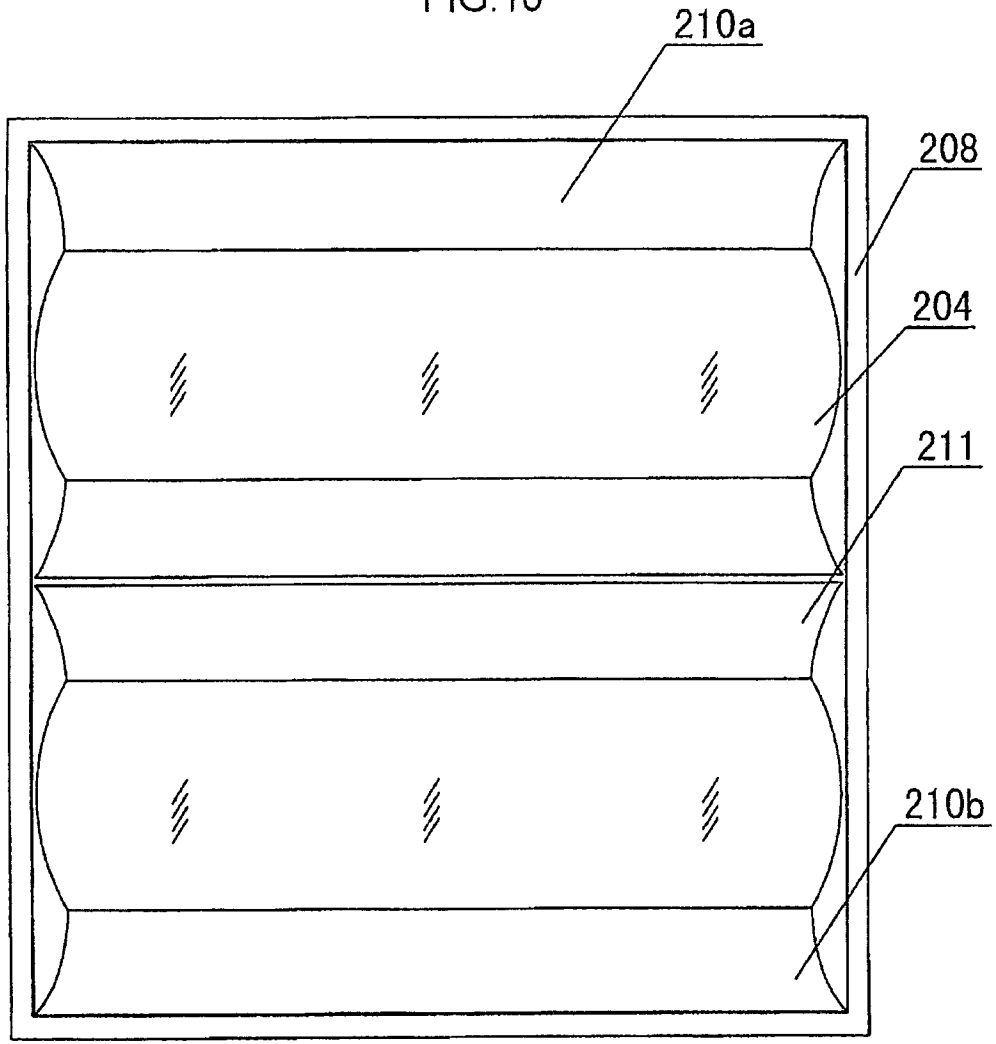
FIG. 10 is the front view of the LED recessed fixture built in FIG. 1.
Figure 11:
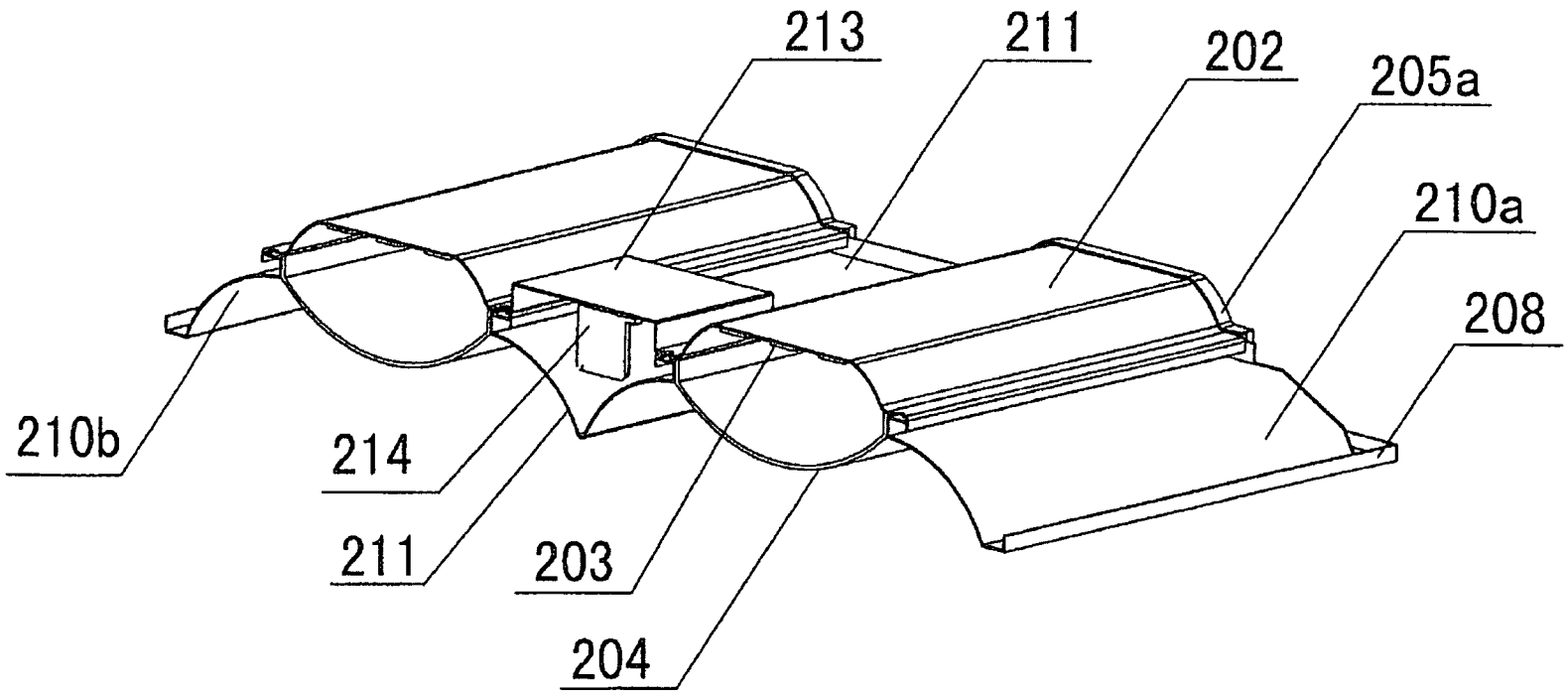
FIG. 11 is the section view of the LED recessed fixture built in FIG. 1.
Figure 12A:
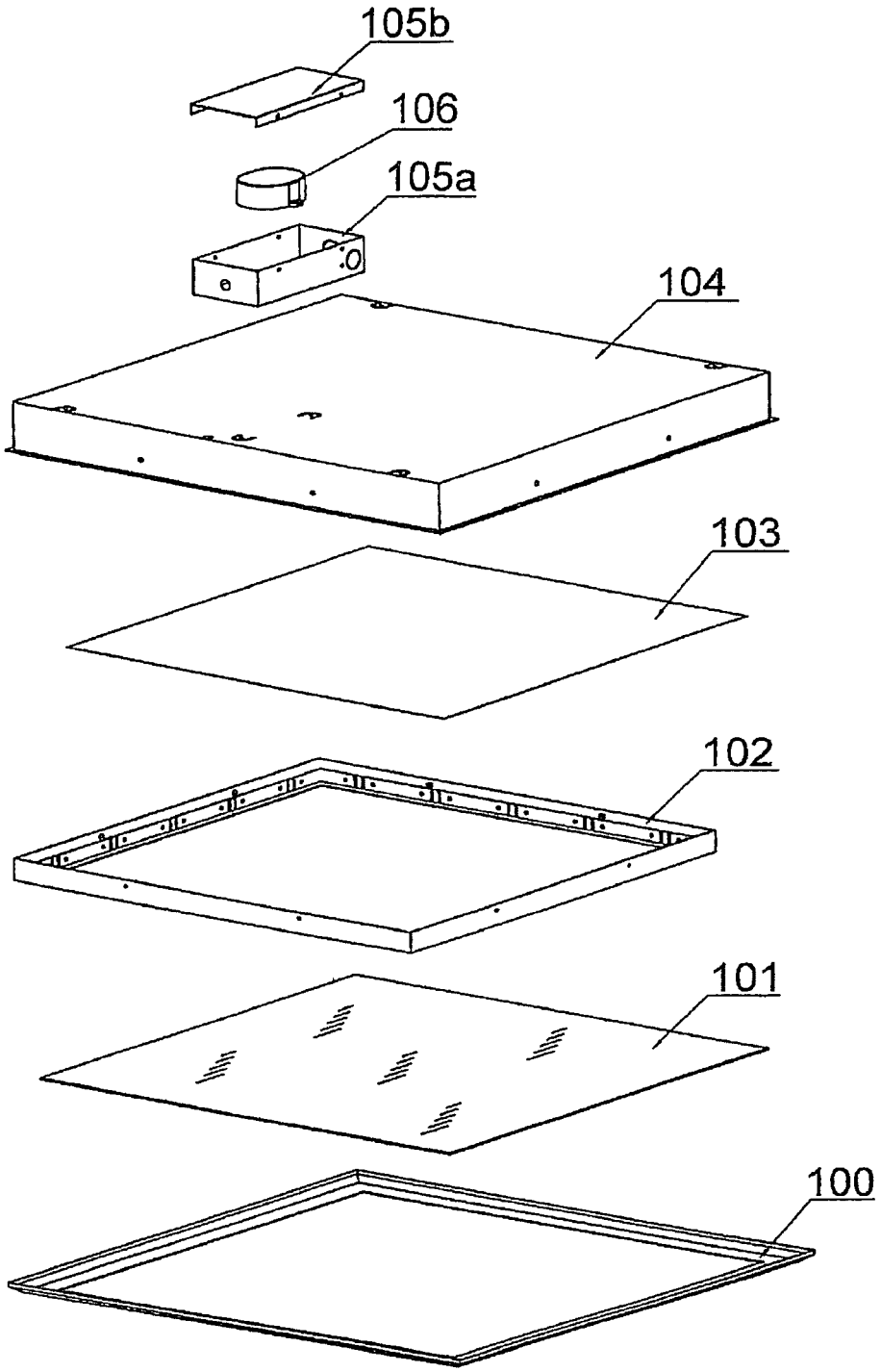
FIG. 12*a* is the exploded view of a conventional LED fixture in accordance with the prior art.
Figure 12B:
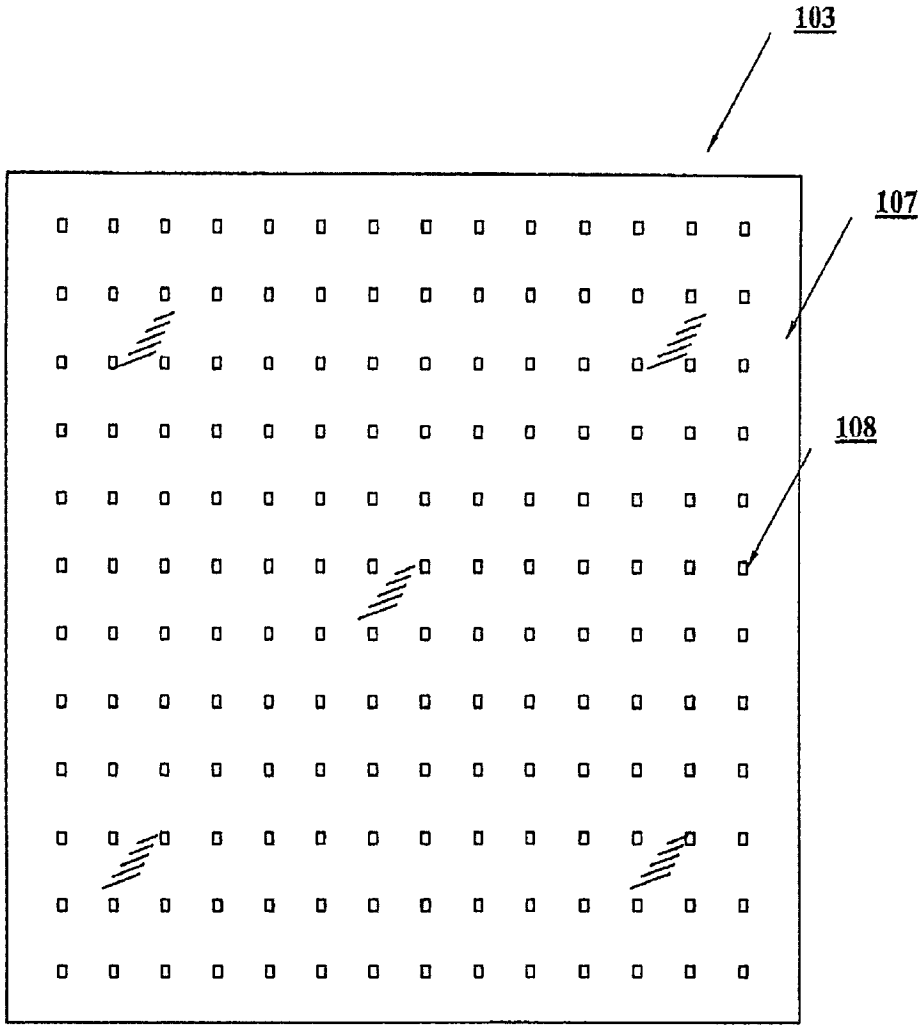
FIG. 12*b* illustrates the LED array in a conventional LED fixture in accordance with the prior art.

Main frame 207 has a baffle 208, a first side bar 209*a*, a second side bar 209*b*, a first side flange 210*a*, a second side flange 210*b*, and a middle flange 211. The said elements 208 to 211 are made of metal. Baffle 208 is the support structure with four sides. The first side bar 209*a* and second side bar 209*b* are securely and vertically coupled on top of two opposite sides of baffle 208. Flanges 210*a*, 210*b* and 211 are arched sheets which extends from the first side bar 209*a* to the second side bar 209*b*. Flanges 210*a* and 210*b* are securely coupled between side bars 209*a* and 209*b* respectively. A first long edge of flange 210*a* is arranged on the third side of baffle 208 and a first long edge of flange 210*b* is securely arranged on the fourth side of baffle 208. Flange 211 is securely coupled between side bars 209*a* and 209*b* and in the center of baffle 208. FIG. 4 is the perspective view of the main frame 207 which has two empty hollows. Flanges 210*a*, 210*b* and 211 are recessed; the first side flange 210*a* and the middle flange 211 forms the first hollow; the second side flange 210*b* and the middle flange 211 forms the second hollow.

Building LED Driver Device 212

LED driver device 212 has a plate 213 and an LED driver 214. Plate 213 is a flat metal sheet. LED driver 214 is a converter device securely coupled on one side of plate 213. LED driver 214 converts AC to constant current DC and further comprises input wire 215 and output wire 216. Both input wire 215 and output wire 216 are UL and/or UR listed. Input wire 215 is electrically connected to line voltage source ranging from 90VAC to 305VAC; output wire 216 transmits constant current DC to LED modules 201 through electrical wire 206.

Assembling LED Modules 201 onto Main Frame 207

Two LED modules 201 are positioned from backside of main frame 207 and securely arranged onto main frame 207 and within the empty hollows.

Assembling LED Driver Device 212 onto Main Frame 207

Electrical wires 206 of LED modules 201 are electrically connected to output wire 216 of LED driver device 212. LED driver device 212 is securely coupled on the backside of middle flange 211 and between LED modules 201.

We claim:

1. A method of assembling a modular LED recessed fixture comprising:

building LED module, which has a base;

at least one LED array arranged on the said base;

a diffuser, made of frosted arched plastic, coupled on top of the said base;

two end caps, made of plastic, secured coupled on each side of the said base;

and an electrical wire coupled on the said LED array leading out through any of the said end caps;

building main frame, which has a baffle;

a first side bar securely and vertically coupled on top of a first side of the said baffle;

a second side bar securely and vertically coupled on top of the opposite side of the said baffle;

a first side flange securely coupled between the said first side bar and the said second side bar and to the third side of the said baffle;

a second side flange securely coupled between the said first side bar and the said second side bar and to the fourth side of the said baffle;

and a middle flange securely coupled between the said first side bar and the said second side bar and in the center of the said baffle;

building LED driver device, which has a plate which is a flat metal sheet;

and an LED driver securely coupled on one side of the said plate, having input wire which is UL and/or UR listed and connected to line voltage source;

and output wire which is UL and/or UR listed and connected to the said electrical wire of the said LED module;

assembling LED modules to main frame, wherein two LED modules are securely arranged within the empty hollows of the main frame;

assembling LED driver device to main frame, wherein the electrical wire of LED modules are connected to output wire of LED driver device. LED driver device is securely coupled on the backside of middle flange and between LED modules.

2. The method of assembling a modular LED recessed fixture according to claim 1, wherein the said base, made of metal, is in a rigid channel shape and has a first end and a second end.

3. The method of assembling a modular LED recessed fixture according to claim 1, wherein the said LED array comprises a plurality of light emitting diodes and a metal core PCB.

4. The method of assembling a modular LED recessed fixture according to claim 1, wherein the said LED driver accepts line voltage source ranging from 90 VAC to 305 VAC and outputs constant current DC.

* * * * *